US008893888B2

(12) United States Patent
Todd et al.

(10) Patent No.: US 8,893,888 B2
(45) Date of Patent: Nov. 25, 2014

(54) PACKAGING AND ASSEMBLY OF DRINK COASTERS

(71) Applicant: Magnet Works, Ltd., St. Louis, MO (US)

(72) Inventors: Curtis L. Todd, St. Louis, MO (US); Anne M. Brown, Kansas City, MO (US)

(73) Assignee: Magnet Works, Ltd., St. Louis, MO (US)

( * ) Notice: Subject to any disclaimer, the term of this patent is extended or adjusted under 35 U.S.C. 154(b) by 0 days.

(21) Appl. No.: 13/737,763

(22) Filed: Jan. 9, 2013

(65) Prior Publication Data

US 2014/0190856 A1 Jul. 10, 2014

(51) Int. Cl.
*B65D 85/62* (2006.01)
*B65D 71/02* (2006.01)

(52) U.S. Cl.
CPC ..... *B65D 71/02* (2013.01)
USPC ..... 206/451; 206/460; 206/499; 211/49.1

(58) Field of Classification Search
USPC ..... 215/394, 393
See application file for complete search history.

(56) References Cited

U.S. PATENT DOCUMENTS

| | | | | | |
|---|---|---|---|---|---|
| 2,956,674 | A | * | 10/1960 | Weilby | 206/451 |
| 3,459,297 | A | * | 8/1969 | Templeton et al. | 206/451 |
| 3,612,264 | A | * | 10/1971 | Trunick | 206/449 |
| 3,987,901 | A | * | 10/1976 | Dullinger | 206/451 |
| 5,588,530 | A | * | 12/1996 | Weder et al. | 206/451 |
| 5,657,870 | A | * | 8/1997 | Schottle et al. | 206/459.5 |
| 5,807,624 | A | * | 9/1998 | Anderson et al. | 428/195.1 |
| 6,548,135 | B1 | * | 4/2003 | Hershey et al. | 428/40.1 |
| 6,708,826 | B1 | * | 3/2004 | Ginsberg et al. | 206/535 |

* cited by examiner

*Primary Examiner* — Anthony Stashick
*Assistant Examiner* — Mollie Llewellyn
(74) *Attorney, Agent, or Firm* — Nixon Peabody LLP

(57) ABSTRACT

A package of coasters comprises a plurality of coasters arranged in a stack and a flexible binding. The flexible binding engages a side portion of each of the plurality of coasters within the stack. The flexible binding includes an adhesive layer to retain each of the plurality of coasters within the stack. The adhesive layer permits at least one coaster to be releasably removed from an original position within the stack. A clear cover may be placed on the uppermost one of the coasters. And, a peelable strap may be affixed to the stack on another side surface of the stack.

10 Claims, 4 Drawing Sheets

PACKAGING AND ASSEMBLY OF DRINK COASTERS

TECHNICAL FIELD

The present invention generally relates to coasters that protect furniture from moisture and/or heat due to containers being disposed thereon. More particularly, the present invention is directed to an assembly of coasters and the packaging of the coasters.

BACKGROUND OF THE INVENTION

It is known that glasses and containers having cold liquids may collect condensation from the ambient air. The water may run down the side of the glass or container and drip onto the furniture. Alternatively, hot containers also have been known to damage furniture surfaces, especially those made of wood.

Drink coasters have been used to alleviate the problems associated with the glasses or containers that may harm the underlying furniture. The coasters separate the glasses or containers from the underlying furniture. Coasters have been made of a variety of materials, including paper and polymers. Oftentimes, the coasters are disposable in that they are discarded after a few uses. Additionally, coasters may include artwork or advertising materials.

One problem with current coasters is related to the manner in which they are assembled and packaged for shipping, distribution, retail display, and storage. Another problem relates to the fact the set of coasters cannot be retained in an assembled state while readily displaying to the user the different artwork and/or advertising that is printed on the coasters within the set. Another problem with existing coaster sets relates to storing them before and after use. The present invention is directed to solving these problems.

SUMMARY OF THE INVENTION

According to one exemplary embodiment, a package of coasters comprises a plurality of coasters, a clear cover, and a flexible binding. The plurality of coasters have a similar shape and are arranged in a stack. The clear cover is positioned over an uppermost one of the plurality of coasters. The clear cover reveals indicia on the uppermost one of the plurality of coasters. The flexible binding engages a side portion of each of the plurality of coasters within the stack. The flexible binding includes an adhesive layer to retain each of the plurality of coasters within the stack.

In accordance to another embodiment, a package of coasters comprises a plurality of coasters arranged in a stack and a flexible binding. The flexible binding engages a side portion of each of the plurality of coasters within the stack. The flexible binding includes an adhesive layer to retain each of the plurality of coasters within the stack. The adhesive layer permits at least one coaster to be releasably removed from an original position within the stack.

In accordance with another aspect, the present invention is a method of packaging a plurality of coasters comprising (i) arranging the plurality of coasters into a stack and (ii) attaching a first side portion of the stack to an adhesive binding. The adhesive binding retains each of the plurality of coasters within the stack. The method may also include coupling a second side portion of the stack so as to inhibit the stack of coasters from pivotably opening around the adhesive binding. The coupling may be accomplished through a peelable strap.

The above summary of the invention is not intended to represent each embodiment, or every aspect, of the present invention. The above features and advantages, and other features and advantages of the present invention, will be readily apparent from the following detailed description of the illustrated embodiments of the present invention when taken in connection with the appended claims.

Figure 1:
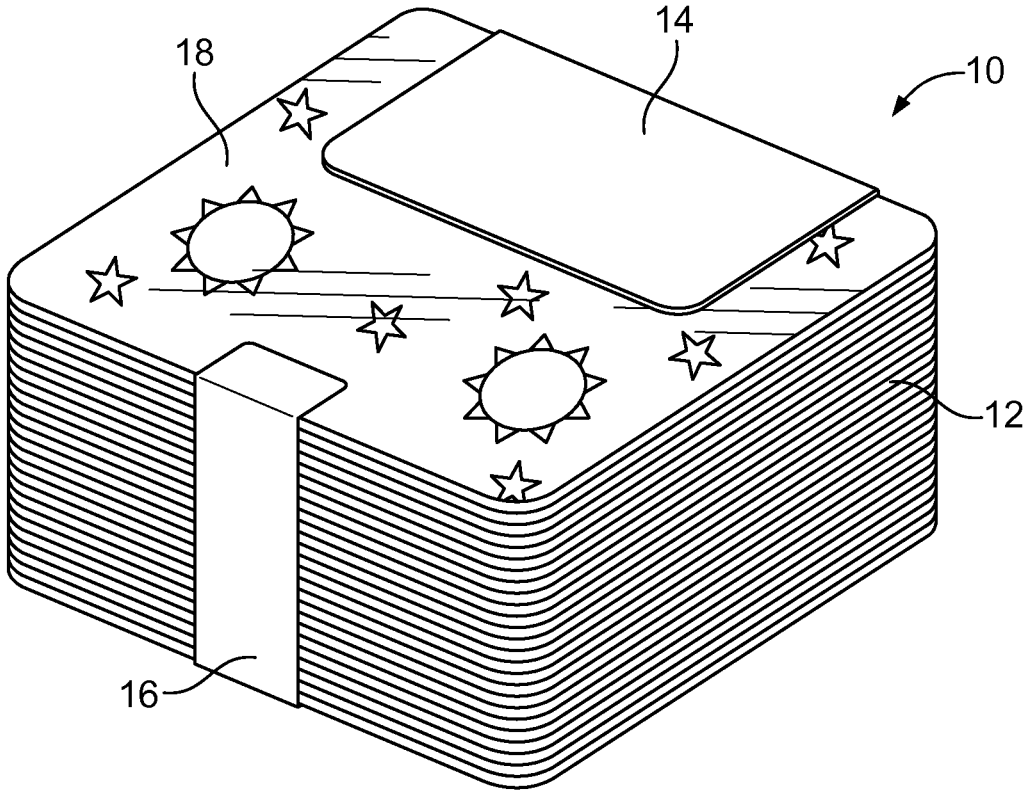
FIG. 1 illustrates a packaged assembly of drink coasters arranged in a stack according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE DRAWINGS

FIG. 1 illustrates a drink coaster assembly 10 that includes a plurality of coasters 12. The coasters 12 are arranged into a stack, which is held together by a binding 14 on a first side of the stack. To keep the stack from opening around the binding 14, a second side of the stack of coasters 12 is held together by a peelable strap 16 that generally opposes the binding 14 on the stack. As shown, the stack contains twenty-five coasters 12, although the number of coasters 12 within the packaged assembly 10 can vary (e.g., five coasters, ten coasters, or fifty coasters).

Because the coasters 12 will typically include artwork and/or advertising indicia, a clear cover 18 is preferably located on top of the stack of coasters 12 to permit viewing of the artwork on the uppermost coaster 12. Although the clear cover 18 is not necessary to the invention, it serves an additional function in that it protects the uppermost coaster 12 during shipping, distribution, and retail display. The clear cover 18 can be made of a variety of plastic materials, such as calendared vinyl or polypropylene. The clear cover 18 is preferably sized and shaped to match the size and shape of each of the coasters 12 within the stack.

Figure 2A:
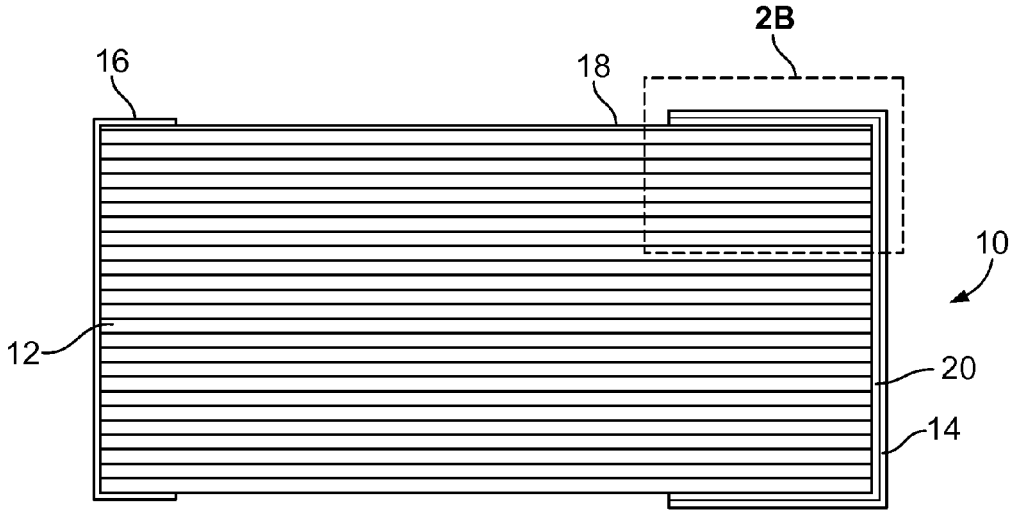
FIG. 2A illustrates a side view of the stack of coasters of FIG. 1.
Figure 2B:
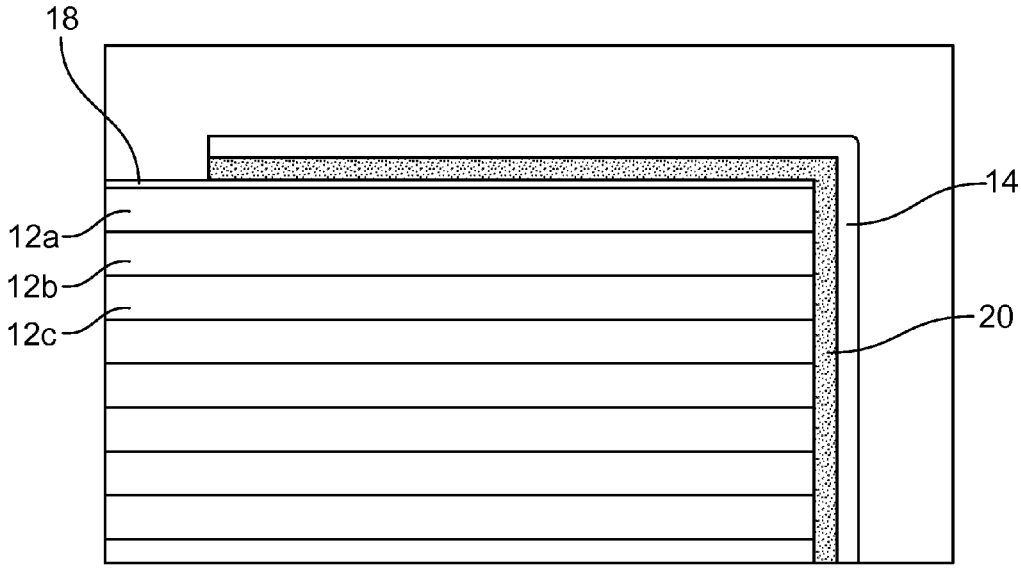
FIG. 2B illustrates an enlarged view of a corner of the stack from FIG. 2A.

FIG. 2A and FIG. 2B illustrate a side view of the packaged assembly 10 and an expanded side view, respectively. The binding 14 includes an adhesive layer 20 that causes the coasters 12 within the stack to be attached along their side edge portions. The adhesive layer 20 is made of a tacky material, which preferably retains its adhesive property after a coaster 12 has been removed so that the removed coaster 12 can be reinserted and reattached to the stack. Examples of materials for the adhesive layer 20 include a rubber adhesive, an acrylic adhesive, or a hot-melt fugitive glue. The main structure of the binding 14 is preferably a paper or polymeric material (which could optionally receive print, such as advertising and marketing print) that is sufficiently strong and flexible to hold the coasters 12 within the packaged assembly 10. In one embodiment, the binding 14 can be in the form of a high tack tape that includes the adhesive layer 20 (such as one of the exemplary adhesives listed above) pre-attached thereto. As shown, the binding 14 extends along only a portion of the first side of the stack although it could extend along the entire first side.

The adhesive layer 20 contacts the side surface of each of the coasters 12 (e.g., the top three coasters 12*a*, 12*b*, 12*c*), which causes the coasters 12 to remain in the stacked configuration. As can be seen in FIG. 2B, the clear cover 18 is thinner than the adjacent coasters 12*a*, 12*b*, 12*c*, although its overall thickness is not critical to the invention. The binding 14 wraps around the clear cover 18 and attaches to its top surface. Similarly, the binding 14 wraps around and attaches to the bottom surface of the lowermost coaster 12 within the stack. The amount of binding 14 that wraps onto the clear cover 18 and the bottom surface of the lowermost coaster 12 can be fairly minimal, such as a 0.1 inch to 0.25 inch, or can be larger if needed (e.g., to accommodate advertising print). Alternatively, a back cover may be used in the packaged assembly 10 below the lowermost coaster 12 within the stack and the binding 14 may wrap around and attach to the bottom surface of the back cover.

Each of the coasters 12 is preferably made of paper material, such as absorbent blotter paper. The coasters 12 are preferably disposable such that they can be discarded after one use or a few uses. The thickness of each coaster 12 is generally between about 0.03 inch and 0.10 inch (preferably about 0.065 inch) such that each coaster 12, by itself, exhibits some level of rigidity. Each of the coasters 12 is about 3.5 inches in width and length so as to accommodate the vast majority of commonly used liquid containers (e.g., plastic bottles, aluminum bottles and cans, wine glasses, carafes, mugs, glass bottles, steins, cups, glasses, etc.). The present invention also contemplates that the coasters 12 may have various polygonal shapes (e.g., rectangles, hexagons, octagons, etc.) and non-polygonal shapes (e.g., circular, elliptical, football-shaped, etc.) as well. Of course, different shapes for the coasters 12 may cause a different shape to be used for the binding 14. The sizes of the coasters 12 may be varied as well.

Figure 3:
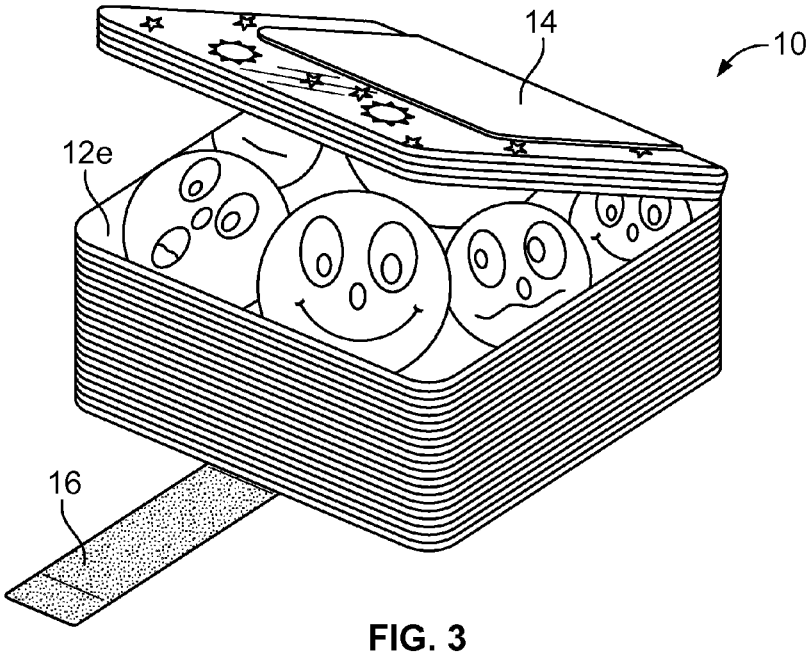
FIG. 3 illustrates the stack of coasters after the package has been opened so as to permit the user to view the artwork on the various coasters within the stack.
Figure 4:
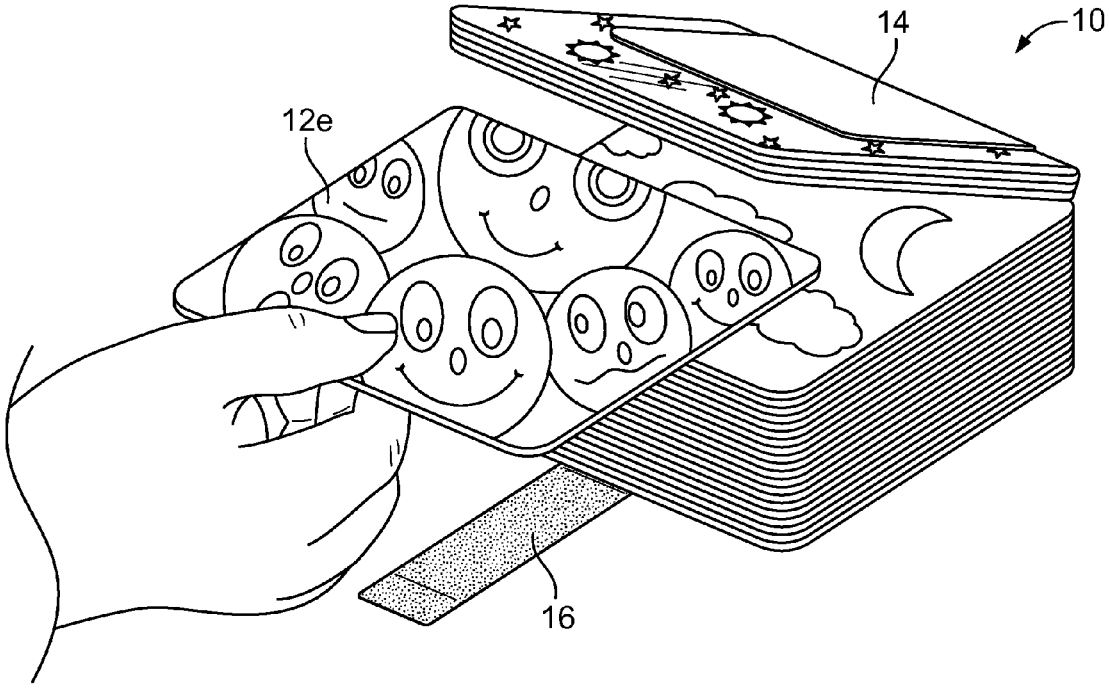
FIG. 4 illustrates a user removing one of the coasters from the stack.

FIGS. 3 and 4 illustrate the packaged assembly 10 after the peelable strap 16 has been removed from the top surface of the clear cover 18, allowing the coasters 12 to be separated from each other while still being retained at their sides by the adhesive layer 20 (FIG. 2B) of the binding 14. Because the binding 14 is flexible, the user can readily view the various artwork and/or advertising indicia on each of the coasters 12 by fanning through the set of coasters 12 as they pivot around the binding 14 (like pages of a book). As shown in FIG. 4, the user can select a coaster 12*e* that he or she prefers. When doing so, the manual force of pulling the coaster 12*e* from the stack causes the side of the coaster 12*e* to become dislodged from the adhesive layer 20 of the binding 14. The adhesive layer 20 has enough cohesion that it remains substantially on the binding 14, although it is understood that some portion may remain on the side surface of the coaster 12*e*. As will described below relative to FIGS. 5-6, by having enough cohesion in the adhesive layer 20 that allows it to remain somewhat (or entirely) intact, the removed coaster 12*e* can be reinserted into the stack in its original position after use and be held by the adhesive layer 20 once again. Additionally, the free end of the peelable strap 16 may also be reconnected to the stack (e.g., by its adhesive) so as to re-assemble the stack of coasters 12 back into the original packaged assembly 10, as shown in FIG. 1.

Figure 5:
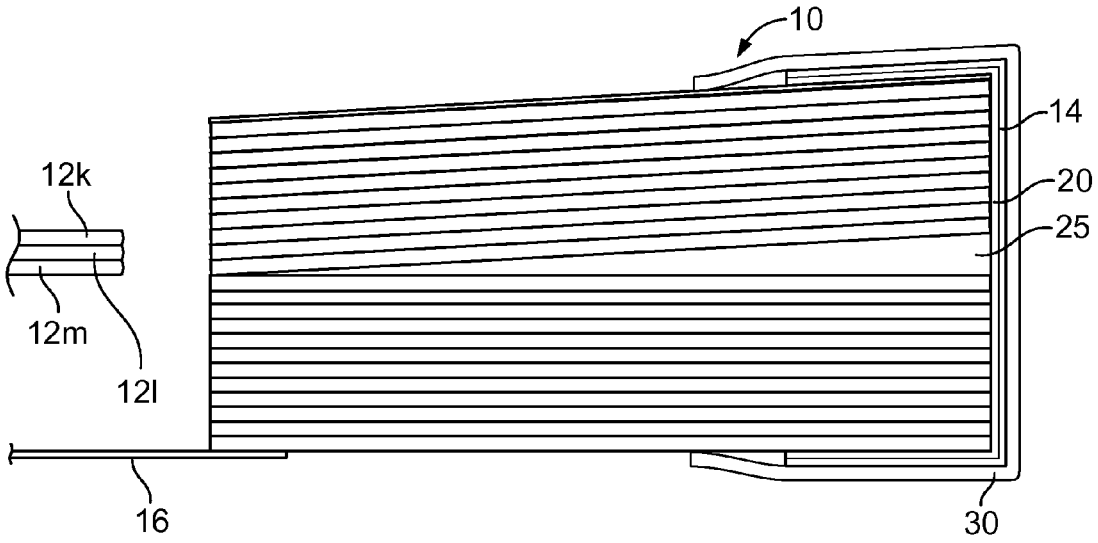
FIG. 5 illustrates a side view of a stack of coasters according to an embodiment of the present invention in which multiple coasters have been releasably removed from the stack.
Figure 6:
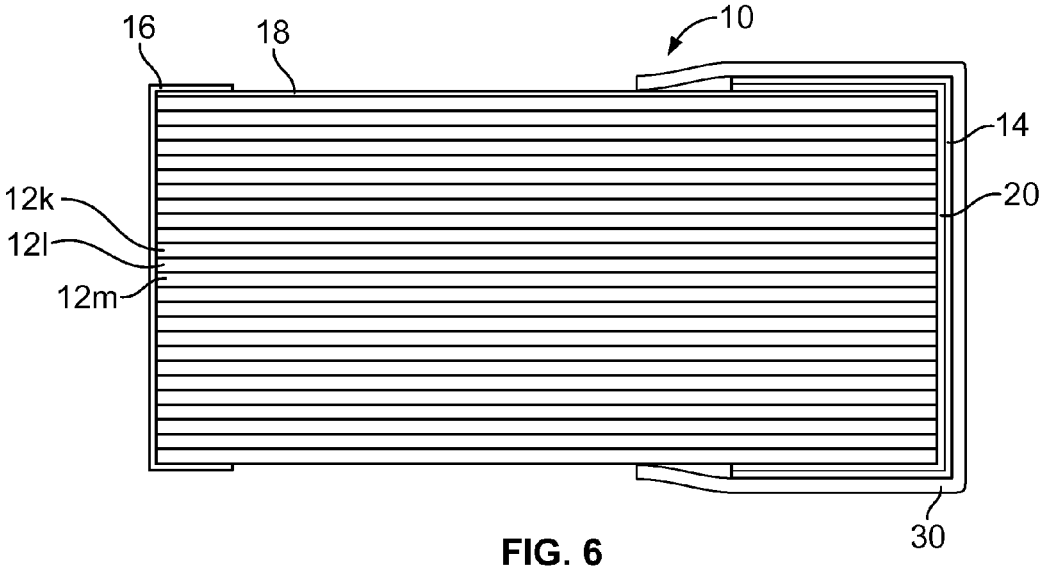
FIG. 6 illustrates the stack of FIG. 5 after the removed coasters have been reinserted into the stack.

FIGS. 5 and 6 illustrate the packaged assembly 10 after the peelable strap has been partially detached from the assembly 10 and multiple coasters 12*k*, 12*l*, 12*m* in the middle of the stack have been removed. When one or more coasters 12 are removed, a gap 25 is created in the stack because the adhesive layer 20 has caused the other (non-removed) coasters 12 to remain substantially in their original positions within the stack. After the multiple coasters 12*k*, 12*l*, 12*m* have been used for their intended purpose of protecting underlying furniture from a liquid container, the multiple coasters 12*k*, 12*l*, 12*m* can be reinserted into the stack in substantially their original positions. The adhesive layer 20 again attaches to the sides of the multiple coasters 12*k*, 12*l*, 12*m* that abut the binding 14. And, the peelable strap 16 can be rewrapped over the stack and attached to the top of the stack. While the reinsertion and reattachment of the removed coaster(s) 12*k*, 12*l*, 12*m* is one beneficial feature of the invention, the present invention contemplates coaster packaging in which reinsertion and reattachment do not occur, or only reinsertion occurs without reattachment to the adhesive layer 20.

FIGS. 5 and 6 also illustrate a label layer 30 that overlays the binding 14. The label layer 30 can be sized to be larger than the binding 14 so that none of the binding 14 can be seen. The label layer 30 is preferably a tear-resistant material that includes a more permanent adhesive such that it is difficult to manually pull the clear cover 18 or bottom coaster 12 from the packaged assembly 10 due to their attachment to the label layer 30. In that regard, the bottom coaster 12 may not be a useful "coaster" as it cannot be removed, but instead is more of a back cover (or a plastic back cover could be used). The label layer 30 may also receive print for marketing or advertising. It should also be noted that the amount of overlapping of the binding 14 onto the clear cover 18 or the bottom surface of the lowermost coaster 12 can be reduced or eliminated when the label layer 30 is used.

It should be noted that the present invention contemplates that the adhesive layer 20 is strong enough to permit the stack to remain together after the peelable strap 16 has been removed. In other words, after the peelable strap 16 has been removed, the stack of coasters can be held up-side-down by grabbing the stack adjacent to the binding 14 and the coasters 12 will not fall from the stack. In this situation, the purpose of the peelable strap 16 is more directed to maintaining the packaged assembly 10 in a tight, closed arrangement during shipping and retail display, such that the user can discard the peelable strap 16 after purchasing the packaged assembly 10 and opening it for the first time. Or, as described above, the free end(s) of the peelable strap 16 can be reattached to the stack after using the coasters 12 to assist in keeping the stack together after coasters have been used.

The present invention contemplates various types of artwork indicia and/or advertising indicia will be used on the coasters 12 of the assembled packages 10. For example, the assembled package 10 of FIGS. 1-6 may include twenty-five different reproductions from a single artist on the twenty-five coasters 25. If a clear cover 18 is used, the bottom side of the lowermost coaster 12 may include smaller-scaled replicas (e.g., 0.5 inch by 0.5 inch) of a few of the other twenty-five different pieces of art to give the prospective purchaser/user an idea of the type of art within the assembled package 10. The present invention also contemplates seasonal artwork, such as coasters 12 for Christmas, the 4$^{th}$ of July, Valentine's Day, St. Patrick's Day, Thanksgiving, etc. Birthday themes, religious themes, and children's themes are options as well.

Additionally, the coasters 12 may have sports-themed indicia, such as a package of thirty coasters 12 in which one coaster is dedicated to each of the thirty franchises in Major League Baseball. Or, all coasters within the assembled package 10 may be dedicated to a single sports team and have a coaster for each player on a team, such as a set of coasters illustrating each player of the St. Louis Cardinals.

The assembled package 10 of coasters 12 may have trivia-themed indicia in which the top surface includes a trivia question and the bottom surface has the answer to the question. Each assembled package 10 may be directed to a different category of trivia. Or, each coaster 12 may have game-themed indicia, such as a SCRABBLE® game board with a preset group of letters already played on the board, and each coaster has its own unique set of playable letters to be played on the preset group of letters on the board. Other word games (e.g., BOGGLE®) and number games (e.g., Sudoku) are possible too.

Unlike prior art coaster sets, the present invention provides an easy method to assemble the packaged set of coasters for shipping, distribution, and retail display. The coasters 12 are stacked, receive the binding 14 with its associated adhesive layer 20, and then receive the peelable strap 16 (or some other secondary smaller binding or clip) to couple together a second side of the stack of coasters 12. And, during use after the user removes the peelable strap 16, the user can readily view each coasters unique indicia by flipping through the coasters 12 because they are held by their sides on the binding 14 through its adhesive layer 20 (almost like flipping through pages of a book). Furthermore, in addition to the fact that the binding 14 allows the set of coasters to be maintained together very well, the adhesive layer 20 on the binding 14 also permits the reinsertion of a removed coaster into the stack after it has been used.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A package of coasters to be used under liquid containers, comprising:

a plurality of coasters, each of the plurality of coasters having a similar shape and being arranged in a stack;

a clear cover positioned over an uppermost one of the plurality of coasters, the clear cover revealing indicia on the uppermost one of the plurality of coasters; and a flexible binding engaging a side portion of each of the plurality of coasters within the stack, the flexible binding including an adhesive layer to retain the clear cover and each of the plurality of coasters within the stack, each of the plurality of coasters being selectively removable in its entirety from the flexible binding such that no portion of the selected one of the plurality of coasters is retained on the flexible binding of the package in response to being removed.

2. The package of coasters of claim 1, wherein the flexible binding wraps onto a top surface of the clear cover and wraps onto a bottom surface of a lowermost one of the plurality of coasters.

3. The package of coasters of claim 1, wherein the adhesive layer permits one of the coasters between the clear cover and a lowermost one of the plurality of coasters to be removably released from the stack and reinserted into the stack after use.

4. The package of coasters of claim 3, wherein the adhesive layer permits the reinserted coaster to become reattached to the flexible binding within the stack after being reinserted.

5. The package of coasters of claim 3, wherein a gap is present between two coasters adjacent to the removed coaster, the two coasters remaining attached to the flexible binding, the reinserted coaster being reinsertable into the gap.

6. The package of coasters of claim 1, further including a peelable strap extending between the clear cover and a lowermost one of the plurality of coasters, the peelable strap being positioned along another side portion of the stack, the peelable strap permitting removal of one or more of the plurality of coasters from the stack upon being peeled away from the stack.

7. The package of coasters of claim 1, wherein the adhesive layer is one of a group consisting of a rubber adhesive, an acrylic adhesive, and a hot-melt fugitive glue.

8. The package of coasters of claim 7, wherein the flexible binding is in the form of tape, the adhesive layer being pre-attached to the tape.

9. The package of coasters of claim 1, wherein the plurality of coasters include coasters having different indicia, the flexible binding permitting the viewing of each of the coasters prior to removal of any of the coasters from the stack.

10. The package of coasters of claim 1, each of the plurality of coasters being made of a material that has a thickness in the range of 0.03 inch to 0.10 inch, such that each coaster exhibits some rigidity.

* * * * *